US008552344B2

(12) United States Patent
Bonassi et al.

(10) Patent No.: US 8,552,344 B2
(45) Date of Patent: Oct. 8, 2013

(54) COOKING METHOD

(75) Inventors: Luca Bonassi, Monza (IT); Paolo Crosta, Gavirate (IT)

(73) Assignee: Whirlpool Corporation, Benton Harbor, MI (US)

( * ) Notice: Subject to any disclaimer, the term of this patent is extended or adjusted under 35 U.S.C. 154(b) by 963 days.

(21) Appl. No.: 12/413,860

(22) Filed: Mar. 30, 2009

(65) Prior Publication Data

US 2009/0255920 A1 Oct. 15, 2009

(30) Foreign Application Priority Data

Apr. 15, 2008 (EP) ..... 08103553

(51) Int. Cl.
*A21B 1/00* (2006.01)

(52) U.S. Cl.
USPC ..... 219/413; 219/402

(58) Field of Classification Search
USPC ..... 219/483, 485, 402, 405, 411, 410, 413, 219/401, 383, 388, 385, 393, 392, 686, 762, 219/752, 730; 99/338, 390, 401, 447; 392/407, 412, 413, 415, 416, 421, 423
See application file for complete search history.

(56) References Cited

U.S. PATENT DOCUMENTS

| | | | | |
|---|---|---|---|---|
| 4,046,989 | A * | 9/1977 | Parise et al. | 219/437 |
| 4,538,049 | A * | 8/1985 | Ryckman, Jr. | 219/386 |
| 5,367,145 | A | 11/1994 | Takagi | |
| 6,417,494 | B1 * | 7/2002 | Westerberg et al. | 219/402 |
| 6,545,251 | B2 | 4/2003 | Allera et al. | |
| 7,060,941 | B1 | 6/2006 | Embury et al. | |
| 7,745,763 | B2 | 6/2010 | Embury et al. | |
| 2002/0175162 | A1 * | 11/2002 | Kim | 219/485 |
| 2006/0151486 | A1 * | 7/2006 | Jung | 219/708 |
| 2008/0135538 | A1 * | 6/2008 | Polley | 219/391 |
| 2008/0302779 | A1 | 12/2008 | Bally et al. | |

FOREIGN PATENT DOCUMENTS

| | | |
|---|---|---|
| EP | 0981961 | 3/2000 |
| EP | 1394472 | 3/2004 |
| EP | 1754939 | 2/2007 |
| EP | 1998116 A1 | 12/2008 |

* cited by examiner

*Primary Examiner* — Henry Yuen
*Assistant Examiner* — Phuong Nguyen
(74) *Attorney, Agent, or Firm* — Diederiks & Whitelaw PLC

(57) ABSTRACT

A cooking method which provides optimized cooking results when starting the cooking process at ambient temperature and that is applicable to the majority of the food categories.

19 Claims, 4 Drawing Sheets

| Oven | Grill_nominal power at 230 volt (watt) | Bake_nominal power at 230 volt (watt) | Balance Grill (%ON in period) | Balance Bake (%ON in period) | Grill_effective power released (Watt) | Bake_effective power released (Watt) | Ratio |
|---|---|---|---|---|---|---|---|
| Whirlpool G2 | 2250 | 1332 | 30% | 90% | 675 | 1199 | 0.6 |
| Whirlpool Vega | 2250 | 1332 | 50% | 100% | 1125 | 1332 | 0.8 |
| Minerva | 2450 | 1150 | 40% | 70% | 980 | 805 | 1.2 |
| Bosch | 1000 | 1300 | 100% | 100% | 1000 | 1300 | 0.8 |
| Dedietich | 1700 | 1200 | 100% | 100% | 1700 | 1200 | 1.4 |

Upper Surface

| | | | | | |
|---|---|---|---|---|---|
| 43 | 46 | 43 | 41 | 40 | 43 |
| 43 | 44 | 45 | 41 | 48 | 42 |
| 46 | 43 | 41 | 41 | 41 | 44 |
| 49 | 40 | 36 | 41 | 40 | 36 |
| 43 | 36 | 38 | 42 | 38 | 33 |
| 47 | 42 | 43 | 43 | 40 | 44 |
| 46 | 42 | 36 | 46 | 41 | 48 |
| 53 | 49 | 48 | 50 | 52 | 50 |
| 52 | 48 | 48 | 51 | 53 | 49 |

Bottom Surface

| | | | | | |
|---|---|---|---|---|---|
| 27 | 27 | 19 | 20 | 23 | 22 |
| 25 | 39 | 34 | 24 | 20 | 28 |
| 22 | 20 | 18 | 17 | 25 | 16 |
| 25 | 24 | 24 | 16 | 20 | 15 |
| 23 | 21 | 26 | 24 | 17 | 15 |
| 26 | 21 | 21 | 20 | 20 | 25 |
| 22 | 20 | 19 | 18 | 17 | 21 |
| 37 | 31 | 20 | 33 | 25 | 28 |
| 28 | 24 | 37 | 36 | 37 | 26 |

Upper Surface

| | | | | | |
|---|---|---|---|---|---|
| 35 | 37 | 36 | 37 | 41 | 41 |
| 36 | 41 | 40 | 41 | 41 | 37 |
| 38 | 39 | 39 | 36 | 36 | 36 |
| 42 | 38 | 37 | 36 | 36 | 37 |
| 39 | 37 | 36 | 34 | 35 | 36 |
| 39 | 41 | 38 | 38 | 36 | 36 |
| 43 | 39 | 39 | 37 | 39 | 36 |
| 41 | 40 | 37 | 36 | 39 | 36 |
| 13 | 39 | 38 | 38 | 39 | 40 |

Lower Surface

| | | | | | |
|---|---|---|---|---|---|
| 30 | 30 | 30 | 31 | 33 | 32 |
| 34 | 36 | 36 | 34 | 34 | 30 |
| 33 | 35 | 34 | 33 | 32 | 33 |
| 35 | 33 | 34 | 32 | 32 | 30 |
| 31 | 33 | 32 | 33 | 31 | 30 |
| 32 | 35 | 33 | 34 | 30 | 32 |
| 34 | 34 | 33 | 31 | 30 | 31 |
| 32 | 33 | 31 | 30 | 31 | 31 |
| 32 | 32 | 31 | 30 | 31 | 32 |

COOKING METHOD

BACKGROUND OF THE INVENTION

1. Field of the Invention

The present disclosure concerns a cooking method particularly suitable for being applied to a domestic cooking oven. More particularly, the subject of the present disclosure is a cooking method adapted to cook foods starting from a low temperature, in particular the ambient temperature.

With the term a "domestic cooking oven" we mean either a built in oven or a free standing cooker provided with a cavity in which an upper and a lower electric heating elements are present. Hidden heating elements are also in the scope of the present invention.

2. Description of the Related Art

In the art cooking methods are known that typically require to preheat the oven cavity before introducing food for cooking. With these known methods it is important to preheat the oven cavity in the shortest possible time, with the aim to reduce delay before starting the actual cooking process. A drawback of these methods is that food cannot be placed into the cavity during the preheat time because otherwise it would burn during preheating, i.e. during a phase in which the heating elements are activated at their maximum power levels.

Also known are cooking algorithms for cooking food starting from a low temperature, the room temperature, allowing the introduction of the food into the cavity since the activation of the heating elements, in order to implement a delayed start of the cooking functions.

These known cooking methods or algorithms do not provide good cooking performances, especially when applied over a wide range of food categories, such as meat, vegetables, pastry and fish because these cooking methods normally, with the exclusion of the preheating phase, use the same not calibrated algorithms of the cooking methods using preheating.

SUMMARY OF THE INVENTION

Aim of the present invention is to provide a cooking method which starts the cooking process at ambient temperature and that is applicable to the majority of the food categories.

BRIEF DESCRIPTION OF THE DRAWINGS

Other features and advantages of the present invention will become readily apparent to the skilled artisan from the following detailed description when read in the light of the accompanying drawings, in which.

DETAILED DESCRIPTION OF THE PREFERRED EMBODIMENTS

Figures 1, 2:
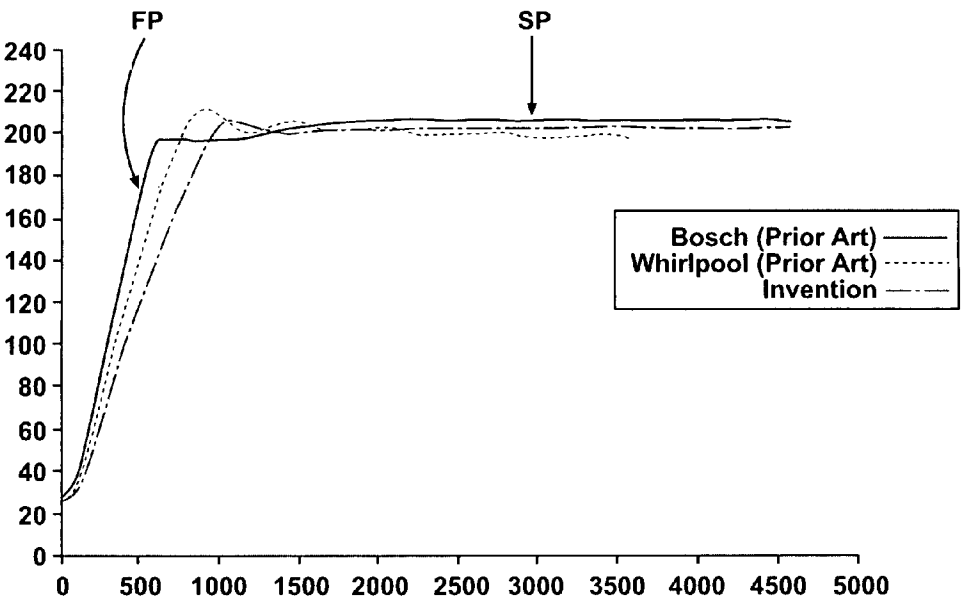
FIG. 1 shows a temperature profile of the algorithm of the present invention, compared with the profiles known in the art.
FIG. 2 is a table in which the parameters of the method according to the invention are compared with the same parameters of the prior art.

With reference to the drawings, an electric oven is provided with an upper heating element rated 2450 W at 230V and a lower heating element rated 1150 W at 230V. The heating elements are driven by an oven electronic control, which is provided with switches useful to connect the electric heating elements to the power supply network which is rated 230V. Other configurations of the heating elements can be applied in order to implement the present method.

The oven can operate with automatic cooking programs that can be started immediately after a keyboard activation or after a predetermined time delay settable through the oven timer. Preferably, the food is inserted into the oven cavity before the oven starts to operate. The initial temperature of the oven is typically the ambient temperature (about 25° C.), even if the temperature can be higher, if a previous cooking function has been executed.

Immediately after the start, or when the time delay elapses, the oven starts energizing the heating elements. According to a preferred embodiment of this method the oven is provided with an electronic control that controls the upper and the lower heating elements with predetermined duty cycles, the cycles referred to a predetermined control period and with the aim to regulate the oven temperature. With this known control method the average power delivered by each of the heating element during the control period can be regulated between zero and the maximum deliverable power, which corresponds to the nominal power of the heater. Electromechanical oven controls are also suitable for implementing the present method.

The cooking method of the present invention presents a first phase (FP), during which the temperature substantially rises, and at least a second phase (SP) during which the temperature level reached during the first phase (FP) is substantially maintained.

During the first phase (FP) the upper heating element is activated with an upper duty cycle (UDC) which corresponds to the 40% (UDC=0.4) of the maximum deliverable power during the control period (the nominal power of the heating element), while the lower heating element is activated with a lower duty cycle (LDC) which corresponds to the 70% of the maximum deliverable power during the control period (LDC=0.7). Preferably, both the duty cycles (UDC, LDC) are maintained constant during the entire first phase.

According to a preferred control configuration, the control period is set equal to 60 seconds. During the control period belonging to the first phase (FP) the upper heating element delivers a nominal average power (UNAP) of 2450 Watt*0.4=980 Watt, while the lower heating element delivers a nominal average power (LNAP) of 1150 Watt*0.7=805 Watt.

The overall value of the nominal average power (ONAP) delivered by the heating elements during the control period is 980 W+805 W=1785 W, and the ratio (R) between the nominal average power released by the upper heating element divided by the nominal average power released by the lower heating element is 980 W/805 W=1,21 (R=1,21).

The whole first phase (FP) of the cooking method is obtained with a combination of control periods during which the overall nominal average power released (ONAP) is still equal to 1785 W and the ratio (R) is equals to 1,2.

The entire first phase (FP) has a duration that is proportional to cooking temperature level (setpoint) that has to be reached and maintained during the second cooking phase (SP). For instance, to reach 200° C. the oven of the present invention takes about 16 minutes.

In an equivalent manner the same behavior of the oven during the first phase (FP) can be obtained with a different control method operating with a different configuration of the control periods and a different activation logic of the heating elements, for instance a sequence of time variable control periods during which the heating elements are alternatively or simultaneously activated, which always results in a overall nominal average power released (ONAP) equals to 1785 W and in a ratio (R) equals to 1,2.

The power ratio (R) of the energy released and the overall nominal average power released (ONAP) during the first phase (FP) are two critical parameters that the applicant has discovered to provide an improved cooking performance, as described below, especially when starting to cook from ambient temperature.

The two above parameters are in fact useful to discriminate between a known preheating phase and the method of the present invention. In fact the overall nominal average power released (ONAP) during the preheating phase is greater than the overall nominal average power released during the execution of a cooking process, as detailed for the method of the present invention, while the power ratio (R) of the elements can be closer to the power ratio used in known preheating methods, and which can depend from the power ratio of the heating elements. The algorithms known in the art normally present a power ratio (R) comprised in the range between 0.6 and 0.8, but, for sake of completeness, it is known that in the marketplace there exist cooking ovens in which the cooking algorithm presents a ratio R=1,4, as reported in FIG. 2. Differently from the present invention, the algorithm of such known ovens is setup to execute a fast preheat of the oven cavity, by releasing an overall nominal average power released (ONAP) that is the maximum amount deliverable by the two heating elements during the entire control period, and obtained by driving the heating elements with a duty cycle equals to 1 (LDC=UDC=1).

At the end of the first phase (FP) the second phase (SP) begins during which the temperature reached at the end of the first phase (FP) is substantially maintained for the entire cooking process in a known manner. During the second phase (SP) the heating elements can be driven with different duty cycles (LDC, UDC). Theses duty cycles can be also varied according to the type of cooking to be performed.

It has been experimentally verified that good cooking performances are also obtainable whenever, during the first phase (FP), the ratio (R) is comprised in the range between 1.1 and 1.3, and whenever the overall average power released during the first phase (OAP) varies +/−6.5% (i.e. between 1670 and 1900 Watt) around the overall nominal average power released (ONAP) according to the power supply and the heating element tolerances.

In FIG. 3 are shown comparative cooking results of the method according to the present disclosure with a typical known method, which is currently implemented on products sold in the market. These comparative tests have been performed by applying the test protocol reported in the European standards EN 60350:200-04, § 8.34.1, and which reveals the objective heat distribution of the heat into the cavity, which is strictly related with the overall cooking performances.

Figure 3A:
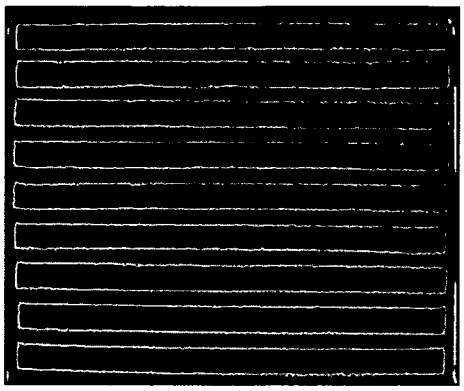
Fig. 3A (PRIOR ART)
FIG. 3A is a picture showing the cooking performances of a prior art method.
Figure 3A:
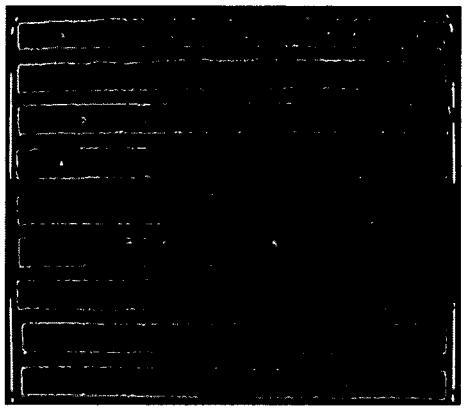
Fig. 3A (PRIOR ART)
Figure 3B:
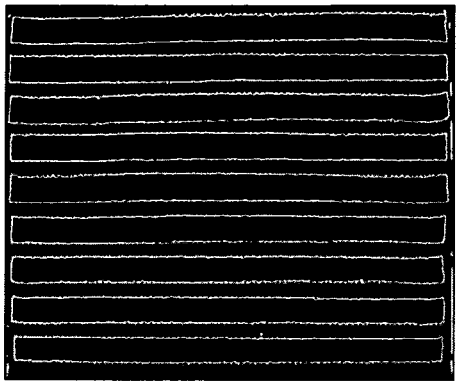
FIG. 3B is a picture showing the cooking performances of the method according to the present invention.
Figure 3B:
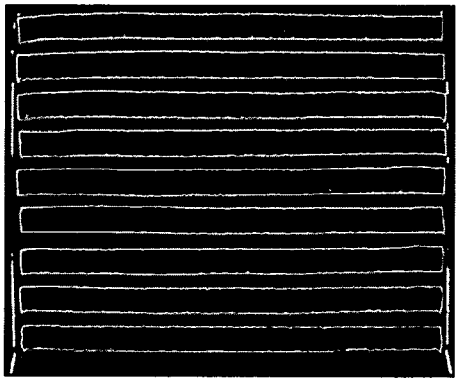

The numeric results reported on FIGS. 3A and 3B represent the measures of the browning grade of the food in each portion of the upper face and on a lower surface resulting from the standard test. Values go from 0 to 100. An objective evaluation of the results can be done starting from the browning grade distributions on the upper and on the lower surface, by calculating their average values, their dispersions and the differences between the corresponding measured and calculated values related to the two surfaces. As shown in FIG. 3B the results obtained by applying the cooking method of the present invention are much better than the representative method of the prior art, whose results are shown in FIG. 3A, because it results in a particularly even distribution of the browning on both the surfaces and moreover the measures between upper surface and bottom surface are very close.

Figure 4:
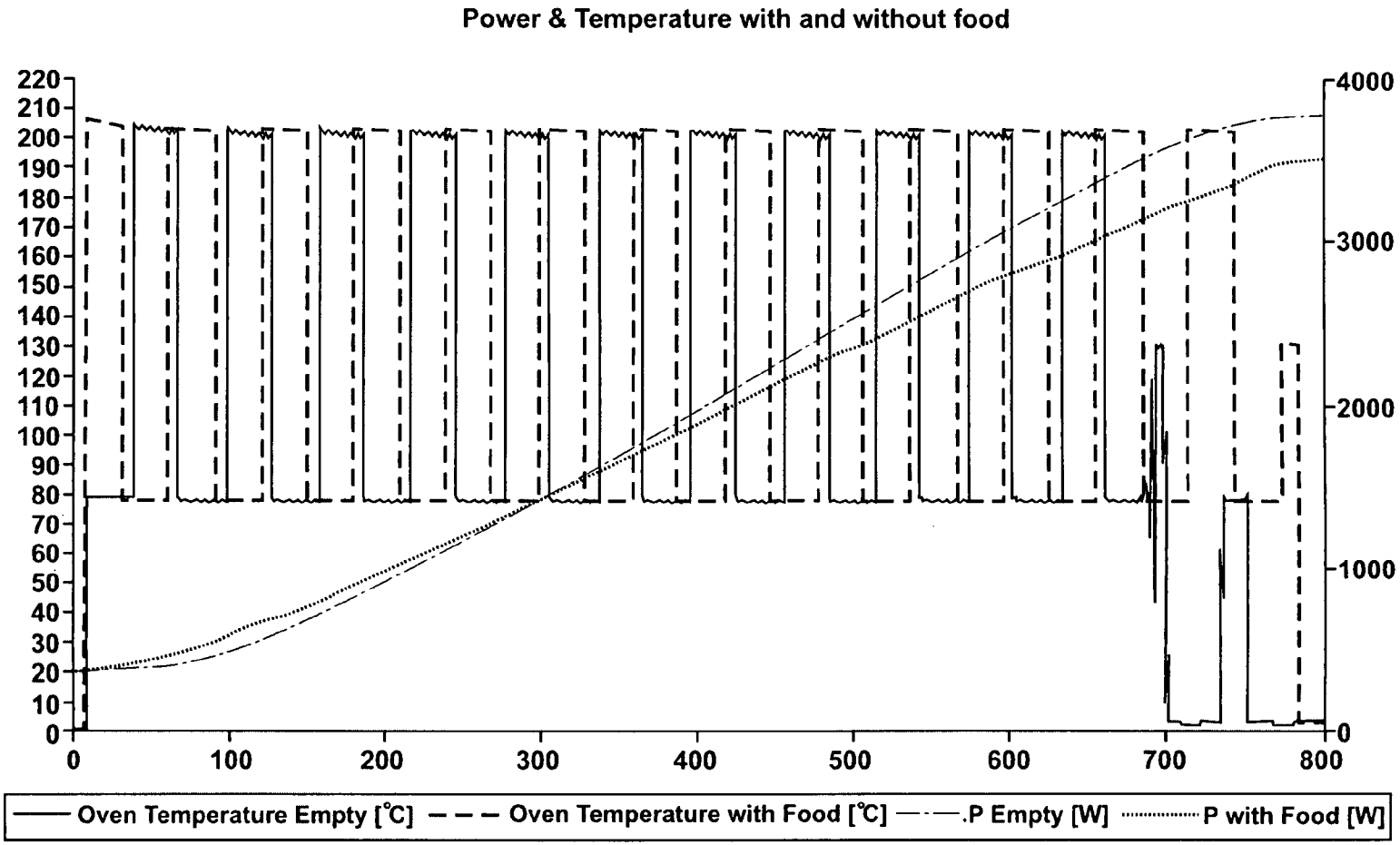
FIG. 4 is a diagram showing the electrical power absorbed by the oven and the temperature thereof with and without food into the oven cavity

According to another aspect of the disclosure, the oven may be provided with an oven temperature acquisition system and with an algorithm able to automatically assess whether the oven is loaded with food or it is empty. European patent application EP1998116 describes a method able to measure the total electrical power absorbed by the oven and to estimate the power delivered to the food with the intent to provide the correct final energy obtaining the desired cooking result. The same or a similar technology could be also used to detect the presence of the food during the preheating phase (FP): in fact, if no food is present during preheating phase, the mentioned algorithm will measure zero power to the food. The concept can be easily understood by the graph of FIG. 4 where the power supplied to the food by the oven is constant during preheating phase, and the temperature measured by the sensor of the oven reacts according the presence of the food inside the cavity: when the oven is empty the temperature increases at a higher rate (solid line) compared to the rate (dotted line) when food is present in the oven cavity.

In the situation in which the oven detects no food in the cavity, the control automatically switches the heating elements to a condition identical to the known traditional preheating phase, therefore reducing the duration of such phase. For instance, if no food is detected, other heating elements may be used in addition to the upper and lower heating elements. According to another feature the total electrical power absorbed by the oven is not measured, but calculated knowing nominal heater resistance value and voltage value. The nominal value of each heater resistance is connected by a factor k stored in the control unit.

It is easy to verify that corresponding surprising results can be obtained when cooking different foods, even when belonging to different food categories. It has been so disclosed a cooking method which provides improved and unexpected cooking results and which allows the user avoiding the preheat phase of the oven.

We claim:

1. A method for controlling an electric cooking oven including a first heating element positioned in an upper area of an oven cavity and a second heating element positioned in a lower area of the oven cavity, the method comprising the steps of:

energizing the first and second heating elements during a first preheating phase in which an oven temperature substantially rises from a first temperature to reach a predetermined set point temperature;

releasing an overall nominal average power from the first and second heating elements combined;

maintaining during the first, preheating phase, a ratio of a nominal average power, defined as a maximum deliverable power of the first heating element times a duty cycle of the first heating element, released by the first heating element to a nominal average power, defined as a maximum deliverable Dower of the second heating element times a duty cycle of the second heating element, released by the second heating element between 1.1 and 1.3 and the overall nominal average power between 1670 and 1900 W.

2. The method for controlling an electric cooking oven according to claim 1, wherein the first heating element is driven with a constant first duty cycle and the lower heating element is driven with a constant second duty cycle during the first, preheating phase.

3. The method for controlling an electric cooking oven according to claim 1, further comprising:

energizing the first and second heating elements to substantially maintain the predetermined set point temperature reached during the first, preheating phase.

4. The method for controlling an electric cooking oven according to claim 1, wherein the first temperature is ambient temperature.

5. The method for controlling an electric cooking oven according to claim 1, further comprising:

performing the first, preheating phase with food within the electric cooking oven.

6. The method for controlling an electric cooking oven according to claim 5, wherein the food includes two or more different food category types selected from the group consisting of meat, fish, vegetables and pastry.

7. The method for controlling an electric cooking oven according to claim 1, wherein the overall nominal average power is about 1785 W.

8. The method for controlling an electric cooking oven according to claim 1, farther comprising:

utilizing an oven temperature acquisition system to perform the steps of;

measuring a total electrical power absorbed by the oven;

automatically detecting a presence of food inside the oven based on the total electrical power absorbed; and implementing the first, preheating phase if the presence of food is detected.

9. The method for controlling electric cooking oven according to claim 1, wherein the nominal average power released by the first heating element equals a maximum deliverable power during the control period multiplied by a duty cycle of the heating element while the nominal average power released by the second heating element equals a maximum deliverable power of the second heating element during the control period multiplied by a duty cycle of the second heating element.

10. A method for controlling an electric cooking oven including a first heating element positioned in an upper area of an oven cavity and a second heating element positioned in a lower area of the oven cavity, the method comprising the steps of:

measuring a total electrical power absorbed by the oven utilizing an oven temperature acquisition system;

automatically detecting a presence or absence of food inside the oven based on the total electrical power absorbed, wherein when the presence of food is detected, a first, preheating phase is implemented including the step of:

energizing the first and second heating elements during a first preheating phase in which an oven temperature substantially rises from a first temperature to reach a predetermined set point temperature;

releasing an overall nominal average power from the first and second heating elements combined;

maintaining during the first, preheating phase, a ratio of a nominal average power, defined as a maximum deliverable power of the first heating element times a duty cycle of the first heating element, released by the first heating element to a nominal average power, defined as a maximum deliverable power of the second heating element times a duty cycle of the second heating element, released by the second heating element between 1.1 and 1.3 and the overall nominal average power between 1670 and 1900 W, wherein when the absence of food is detected, a second, preheating phase is implemented including the step of:

operating the first and second heating elements such that the predetermined set point temperature is reached in a shortest amount of time possible given a maximum power deliverable by the first and second heating elements.

11. The method for controlling an electric cooking oven according to claim 6, further comprising:

implementing the first, preheating phase such that the predetermined set point temperature is reached in a time greater than the shortest amount of time possible given an average maximum power deliverable by the first and second heating elements.

12. The method for controlling an electric cooking oven according to claim 10, wherein the first heating element is driven with a constant first duty cycle and the lower heating element is driven with a constant second duty cycle during the first, preheating phase.

13. The method for controlling an electric cooking oven according to claim 10, further comprising:

energizing the first and second heating elements to substantially maintain the predetermined set point temperature reached during either the first or second preheating phase.

14. The method for controlling an electric cooking oven according to claim 10, wherein the first temperature is ambient temperature.

15. The method for controlling an electric cooking oven according to claim 1, wherein the overall nominal average power is about 1785 W.

16. The method for controlling an electric cooking oven according to claim 1, wherein the overall nominal average power is less than a maximum power deliverable by the first and second heating elements.

17. The method for controlling an electric cooking oven according to claim 10, wherein the overall nominal average power is less than a maximum power deliverable by the first and second heating elements.

18. The method for controlling an electric cooking oven according to claim 1, further comprising:

after the first preheating phase, varying a duty cycle of at least one of the first and second heating elements during a second, cooking phase according to the type of cooking to be performed.

19. The method for controlling an electric cooking oven according to claim 10, further comprising:

varying a duty cycle of at least one of the first and second heating elements during a cooking phase according to the type of cooking to be performed.

* * * * *